US006041577A

United States Patent [19]

Walz et al.

[11] Patent Number: 6,041,577

[45] Date of Patent: Mar. 28, 2000

[54] METHOD AND APPARATUS FOR SLICING ELONGATED FOOD ARTICLES INTO SLABS AND TRANSFERRING THE SLABS TO CONTAINERS

[75] Inventors: John C. Walz, Bloomfield; Gilbert M. Foulon, Jr., Wanaque, both of N.J.

[73] Assignee: Solbern, Fairfield, N.J.

[21] Appl. No.: 09/150,570

[22] Filed: Sep. 10, 1998

Related U.S. Application Data

[60] Provisional application No. 60/058,644, Sep. 11, 1997.

[51] Int. Cl.[7] ..... B65B 63/00; B65B 1/04

[52] U.S. Cl. ..... 53/515; 53/236; 83/425.2; 83/932

[58] Field of Search ..... 53/514, 515, 247, 53/236, 252; 83/932, 167, 425.2, 437.2, 858

[56] References Cited

U.S. PATENT DOCUMENTS

| | | | |
|---|---|---|---|
| 3,434,515 | 3/1969 | Farmer | 53/515 |
| 3,468,098 | 9/1969 | Eisenberg . | |
| 3,662,518 | 5/1972 | Eisenberg . | |
| 4,453,368 | 6/1984 | Egee . | |
| 4,537,017 | 8/1985 | Hengstenberg et al. . | |
| 4,646,509 | 3/1987 | Tribert . | |
| 5,121,591 | 6/1992 | Backus et al. | 53/515 |
| 5,337,640 | 8/1994 | Arnoth et al. . | |

*Primary Examiner*—John Sipos
*Assistant Examiner*—Steven Jensen
*Attorney, Agent, or Firm*—Allen N. Friedman; McCarter & English, LLP

[57] ABSTRACT

The apparatus of the present invention includes an indexing feeder for feeding the elongated food articles, a first slicing station and a second slicing station disposed along the indexing feeder for slicing the food articles into slabs, and a container conveyor system for delivering containers to receive the slabs. The articles are placed individually into winged troughs ("flights") carried by the indexing feeder and the feeder is advanced by two flight spacings in each slicing cycle. The second slicing station is displaced from the first slicing station by an odd number of flights. Each slicing station further includes an indexing turret with a number of self-centering chucks disposed around the periphery of the turret. The turret is rotated in such a way so as to allow a food article to be inserted into each chuck as the chuck rotates past the indexing feeder. Each slicing station also includes a slicing head, a slicing ram for thrusting the food article through the slicing head after the chuck is rotated into alignment with the slicing head at the slicing position. In addition, a splitter wedge extends from the slicing head of the first slicing station. Such splitter wedge is V-shaped at the end distal to the slicing head and tapering to a knife edge proximal to the slicing head at the center line of the slicing head, whereby slabs emerging from the first slicing station are separated into two portions as they are inserted into the container. The angle at which the container is held and the velocity of insertion are selected such that the slices come to rest lying against opposite sides of the container, exposing the cucumber "meat" to consumer view. At the second slicing station, the slices remain together and are inserted between the two portions in order to fill the containers.

39 Claims, 16 Drawing Sheets

METHOD AND APPARATUS FOR SLICING ELONGATED FOOD ARTICLES INTO SLABS AND TRANSFERRING THE SLABS TO CONTAINERS

RELATED U.S. APPLICATION DATA

This patent application claims the benefit under 35 U.S.C. §119(e) of U.S. Provisional Patent Application Serial No. 60/058,644, filed on Sep. 11, 1997. The disclosure of the foregoing Provisional Patent Application is incorporated herein by reference.

FEDERALLY SPONSORED RESEARCH

NONE.

THE INVENTION

BACKGROUND OF THE INVENTION

1. Field of Invention

The present invention relates generally to a method and apparatus for slicing elongated food articles into slabs and transferring such slabs into containers. More particularly, a preferred embodiment of the present invention may be applied to pickle processing and packaging.

2. Description of the Related Art

In general, cucumbers to be used as pickles are cut into longitudinal "spears" and then stored in containers. A "spear" is a longitudinally cut piece having a generally triangular cross-section. A number of methods and equipment have been developed to improve the process of creating and packing "spears". See, for example, Eisenberg, U.S. Pat. No. 3,468,098; Eisenberg, U.S. Pat. No. 3,662,518; Egee, U.S. Pat. No. 4,453,368; Hengstenberg, U.S. Pat. No. 4,537,017; and Arnoth et al., U.S. Pat. No. 5,337,640. However, due to the triangular size of each spear and the geometry of the jar, the available storage space of each jar is usually not optimally utilized, thereby resulting in inefficient and wasteful packaging.

A recently popularized pickle style is the "slab" pickle, for use in sandwiches. This requires that the cucumbers be sliced into longitudinal, uniformly thick slices. This has been done using either one of two known slicing methods. In one such method, an opposing belt conveyor grips and accelerates the cucumber to a high velocity thereby sending it freely through a column of stationary blades. The individual slices are then propelled through a tube into a curtain or water bath to slow them to a stop. This slicing method is generally not very efficient. The high speed encounter of the whole cucumber with the blades and of the slices with a decelerating media impart damage to the slices resulting in a lower yield.

In a second lesser known method, water knife technology is used to slice the cucumber. This method is generally regarded as slow. In addition, it requires very high costs in both initial investment and maintenance.

According to present cucumber packing practice, after slicing the slices are delivered to a work area of between sixty (60) to seventy (70) packing personnel or packers via a wide belt conveyor or tote pans. A continuous supply of jars moves past each packing station. Each packer then takes an empty jar and manually places fourteen (14) to eighteen (18) slices into the jar and returns it full to the glass line conveyor. Throughput averages about one hundred and twenty (120) jars per minute. At sixth-five (65) packers, the rate per packer is less than two (2) jars per minute. Yields reportedly vary from fifty (50) to sixty (60) percent.

SUMMARY OF THE INVENTION

It is accordingly an object of the present invention to provide a method and apparatus for slicing elongated food articles into slabs.

It is another object of the present invention to provide a method and apparatus to efficiently pack slabs cut from elongated food articles into a container such that the container presents a visually attractive appearance.

It is a further object of the present invention to provide a method and apparatus to pack slabs cut from elongated food articles into a container with minimal human intervention.

It is yet another object of the present invention to provide a method and apparatus to increase the rate of packing of slabs cut from elongated food articles.

It is still another object of the present invention to provide a method and apparatus to is increase yield through better product utilization and gentler handling.

Briefly, the apparatus of the present invention includes an indexing feeder for feeding the elongated food articles, a first slicing station and a second slicing station disposed along the indexing feeder for slicing the food articles into slabs, and a container conveyor system for delivering containers to receive the slabs. The articles are placed individually into winged troughs ("flights") carried by the indexing feeder and the feeder is advanced by two flight spacings in each slicing cycle. The second slicing station is displaced from the first slicing station by an odd number of flights. Each slicing station further includes an indexing turret with a number of self-centering chucks disposed around the periphery of the turret. The turret is rotated in such a way so as to allow a food article to be inserted into each chuck as the chuck rotates past the indexing feeder. Each slicing station also includes a slicing head, a slicing ram for thrusting the food article through the slicing head after the chuck is rotated into alignment with the slicing head at the slicing position. In addition, a splitter wedge extends from the slicing head of the first slicing station. Such splitter wedge is V-shaped at the end distal to the slicing head and tapering to a knife edge proximal to the slicing head at the center line of the slicing head, whereby slabs emerging from the first slicing station are separated into two portions as they are inserted into the container. The angle at which the container is held and the velocity of insertion are selected such that the slices come to rest lying against opposite sides of the container, exposing the cucumber "meat" to visual view by purchasers. At the second slicing station, the slices remain together and are inserted between the two portions in order to fill the containers.

The preceding and other features and advantages of the present invention will be described by way of the following examples taken in conjunction with the figures provided below.

DETAILED DESCRIPTION OF THE PREFERRED EMBODIMENTS

Figure 1:
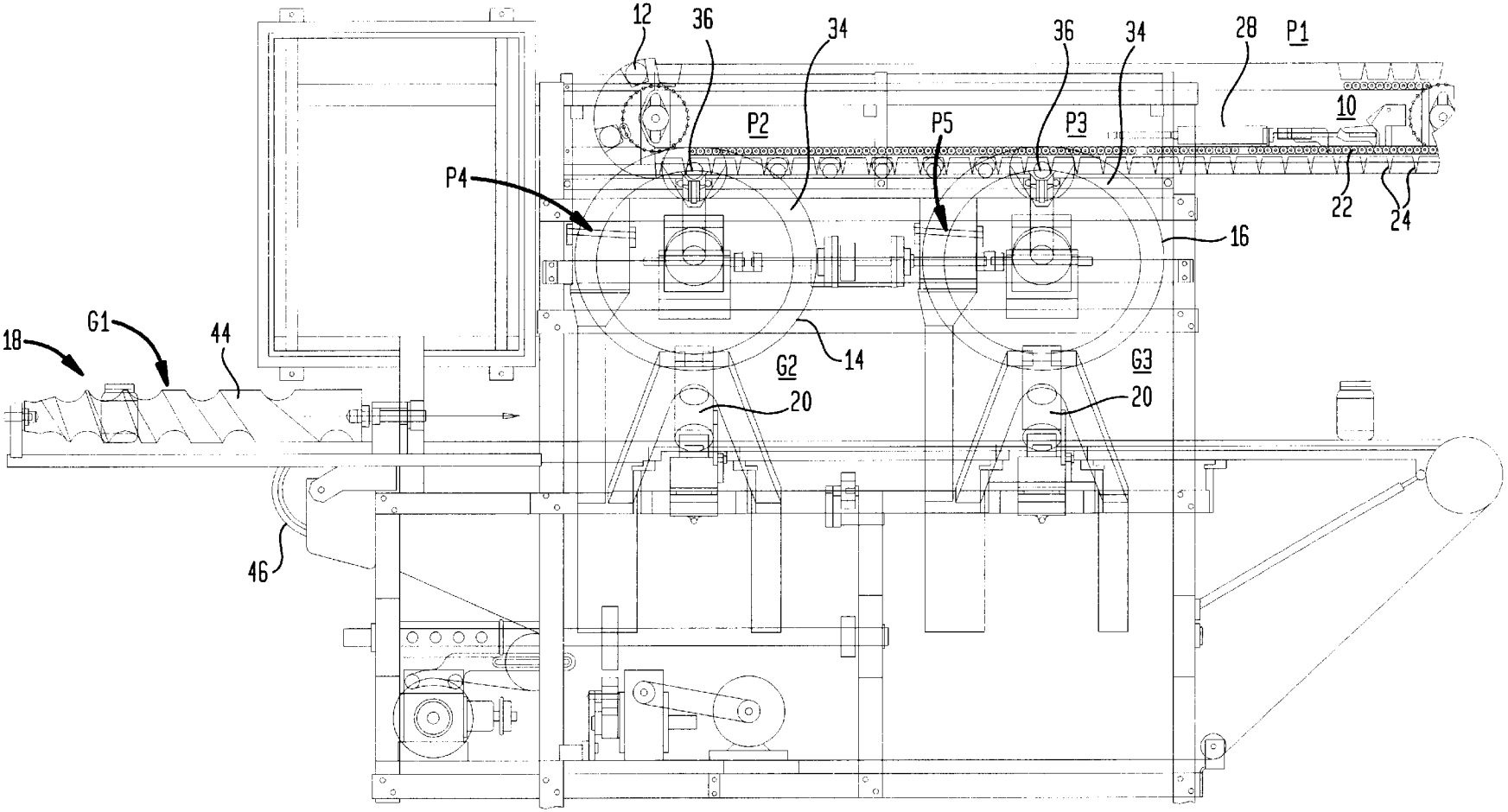
FIG. 1 is an elevational view showing a preferred embodiment of the present invention.

A preferred embodiment of the present invention is shown as a schematic diagram in FIG. 1. The preferred embodiment includes an indexing feeder 10 for feeding the elongated food articles 12, a first slicing station 14 and a second slicing station 16 disposed along the indexing feeder 10 for slicing the food articles 12 into slabs, and a container conveyor system 18 for delivering containers 20 to receive the slabs.

Figure 2:
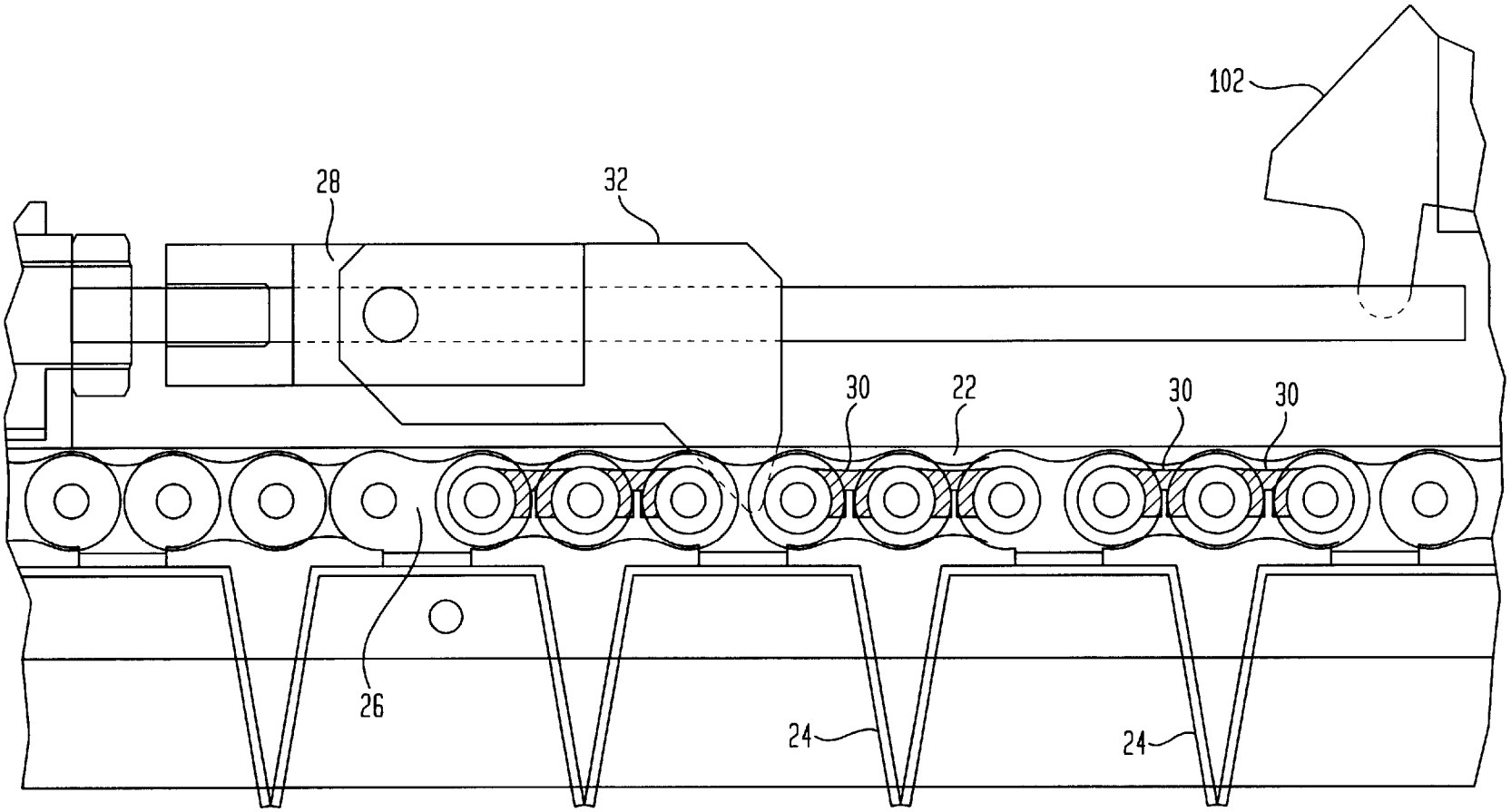
FIG. 2 is an elevational view showing the indexing feeder.

FIG. 2 is a schematic diagram showing in greater details the indexing feeder 10 of the apparatus. The indexing feeder 10 has several components including an indexing chain 22, a number of troughs 24 each independently affixed to a link 26 of the indexing chain 22 at a distance of one flight from neighboring troughs 24, and an indexing drive 28 for advancing the indexing chain 22 by a distance of two flights during each slicing cycle. Roller chain inserts 30 are inserted to prevent the drive head 32 from dropping into an incorrect chain link space, thereby preventing misindexing of the troughs 24.

The second slicing station 16 is displaced from the first slicing station 14 by an odd number of flights. This assures that there will always be a filled trough 24 at the second slicing station 16. Each slicing station 14, 16 further includes an indexing turret 34 with a number of self-centering chucks 36 disposed around the periphery of the turret 34. The turret 34 is rotated in such a way so as to allow a food article 12 to be inserted into each chuck 36 as it passes the indexing feeder 10. Each slicing station 14, 16 also includes a slicing head 38, a slicing ram 40 for thrusting the food article 12 through the slicing head 38 as the chuck 36 is rotated into alignment with the slicing head 38 at the slicing position. In addition, a splitter wedge 42 (see FIG. 8) extends from the slicing head 38 of the first slicing station 14. Such splitter wedge 42 is V-shaped at the end distal to the slicing head 38 and tapering to a knife edge 88 proximal to the slicing head 38 at the center line of the slicing head 38, whereby slabs emerging from the first slicing station 14 are separated into two portions. The foregoing features can be better understood as the operation of the preferred embodiment is explained below.

The features and operation of the preferred embodiment are more easily followed by referring to FIG. 1. The preferred embodiment generally operates in two cycles, namely, the product conveyor index cycle and the slicing cycle. During the product conveyor index cycle, the containers 20 and the food articles 12 are each delivered to their respective positions in preparation for the slicing cycle. During the slicing cycle, the food articles 12 are sliced into "slabs" and then packed into the containers 20. Details of the operation of the preferred embodiment are described below.

Figure 3:
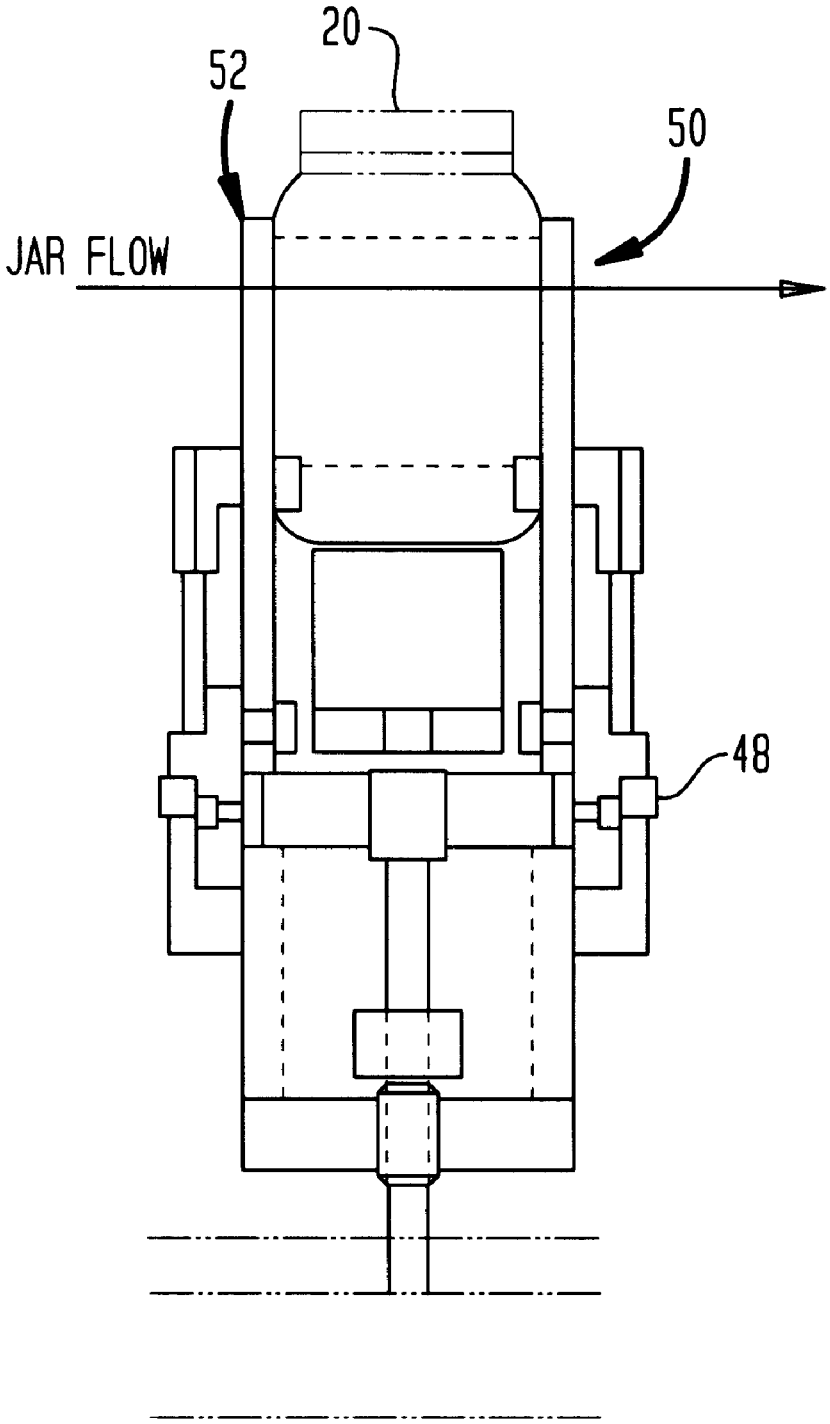
FIG. 3 is an elevational view from the output end of the present invention.

Containers 20, such as jars, are fed to the in-feed timing screw 44 at "G1", which accelerates them from choke pitch in a staging area (not shown) to a velocity matching the apparatus's continuously moving belt conveyor 46. As FIG. 3 shows, the containers 20 are retained laterally by guide rails 48 that gradually orient them from their initial vertical entry orientation to their angled filling orientation as the belt 46 advances. The angle has been optimized to assure that the slabs 110 (see FIG. 22) come to rest against the bottom of the container 20 and lying approximately parallel to one another and spread out against the side of the container 20. In the illustrated preferred embodiment, the angle is approximately forty-five degrees (45°). A container 20 is stopped at the first slicing station 14 by the first station stop flag 50 at "G2" to receive the first of two sliced food articles. As soon as the container 20 is stopped, the escapement's control flag 52 moves behind the container 20 to secure it. The container 20 is then lifted upwards off the conveyor 46 against the slicing head 38, where the first food article 12 is sliced and inserted. The container 20 is then lowered back onto the conveyor 46, and the stop flag 50 lowered to allow the container 20 to advance to the second slicing station 16. The control flag 52 keeps the advancing containers 20 from entering the station 14 until the filled container 20 passes the stop flag 50. When the filled container 20 clears the stop flag 50, the stop flag 50 moves up behind the filled container 20 at the same time as the control flag 52 is retracted, thereby allowing the next container 20 to enter the station 14 for filling. The conveyor belt 46 can be a steel link chain captured within a polymer tube made, for example, of polyurethane or polyvinyl chloride.

Filled containers 20 from the first slicing station 14 enter the second slicing station 16 where the same container positioning and loading techniques are employed and the sliced article, retaining the parallel orientation of its slices 112 (see FIG. 22) is inserted at the center of the previously filled slices 110. After leaving the second slicing station 16, the guide rails 48 return the filled container 20 to a vertical orientation. Each container 20 is then discharged onto an adjustment area (not shown), where four (4) to five (5)

packers manually place additional slices in order to completely fill up the container 20.

At the start of the process, one operator manually places the entire elongated food articles 12, such as cucumbers, onto the indexing feeder 10 at "P1." The indexing feeder 10 indexes the food articles 12 around to the turret loading areas, "P2" and "P3". By indexing two flights at a time, loading from every other flight, and spacing the loading areas by an odd number of flights, there is always a food article 12 available at both loading areas. During the product conveyor index cycle, a plunger 54 at each loading area moves the food articles 12 from the indexing feeder 10 and inserts them into the uppermost chuck of an eight position indexing turret 34.

Figure 4:
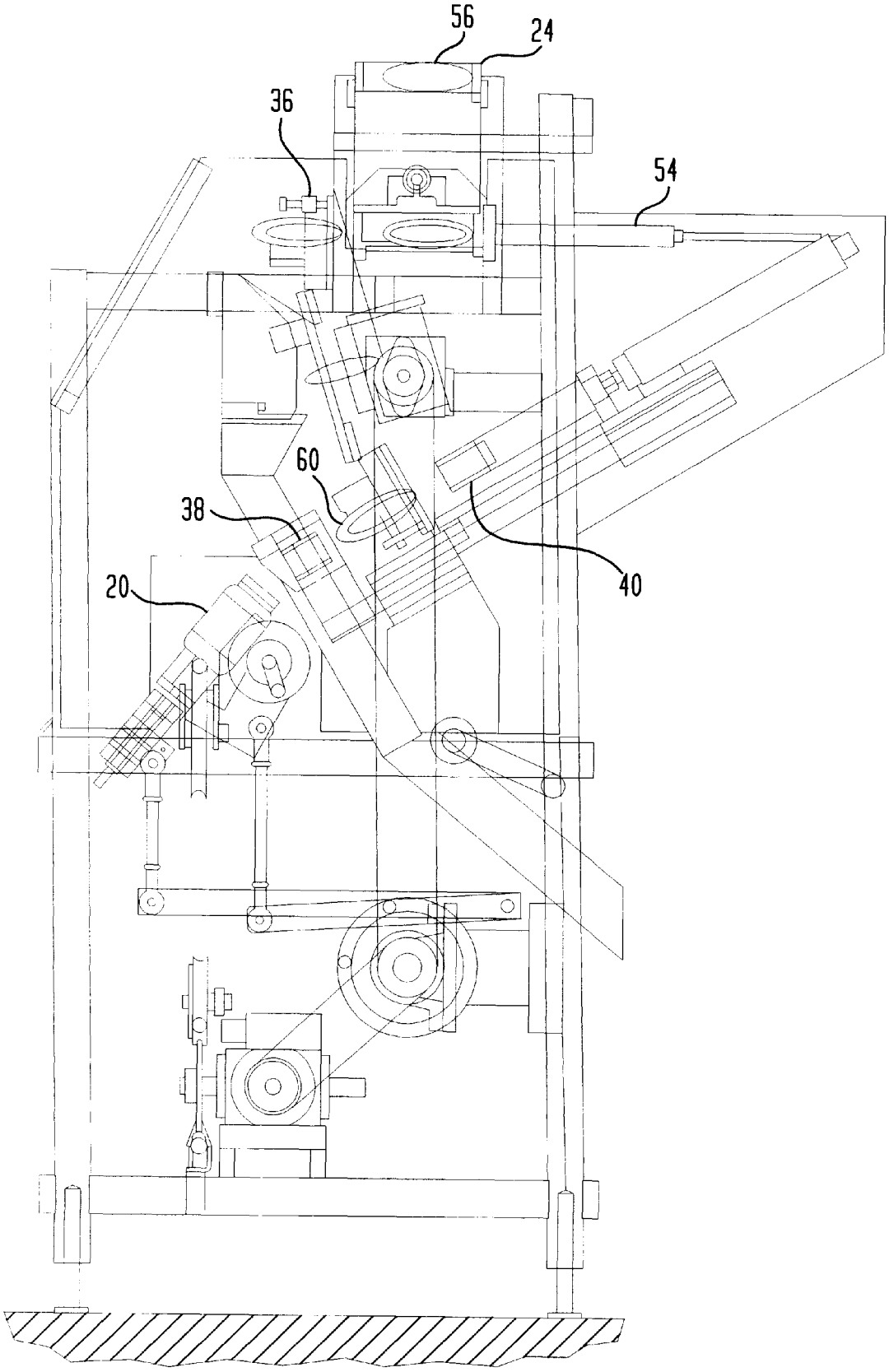
FIG. 4 is an elevational view of a section of the device of FIG. 1 showing the side view of the turret and the conveyor belt.

FIG. 4 is an elevation view from the output end of the apparatus. A food article 56 is loaded into a flight 24. A second food article 58 is in position to be inserted into a chuck 36 by a plunger 54. A third food article 60 is in position to be pressed through the slicing head 38 by the slicing ram 40 after the container 20 is raised to meet the slicing head 38.

Figure 5:
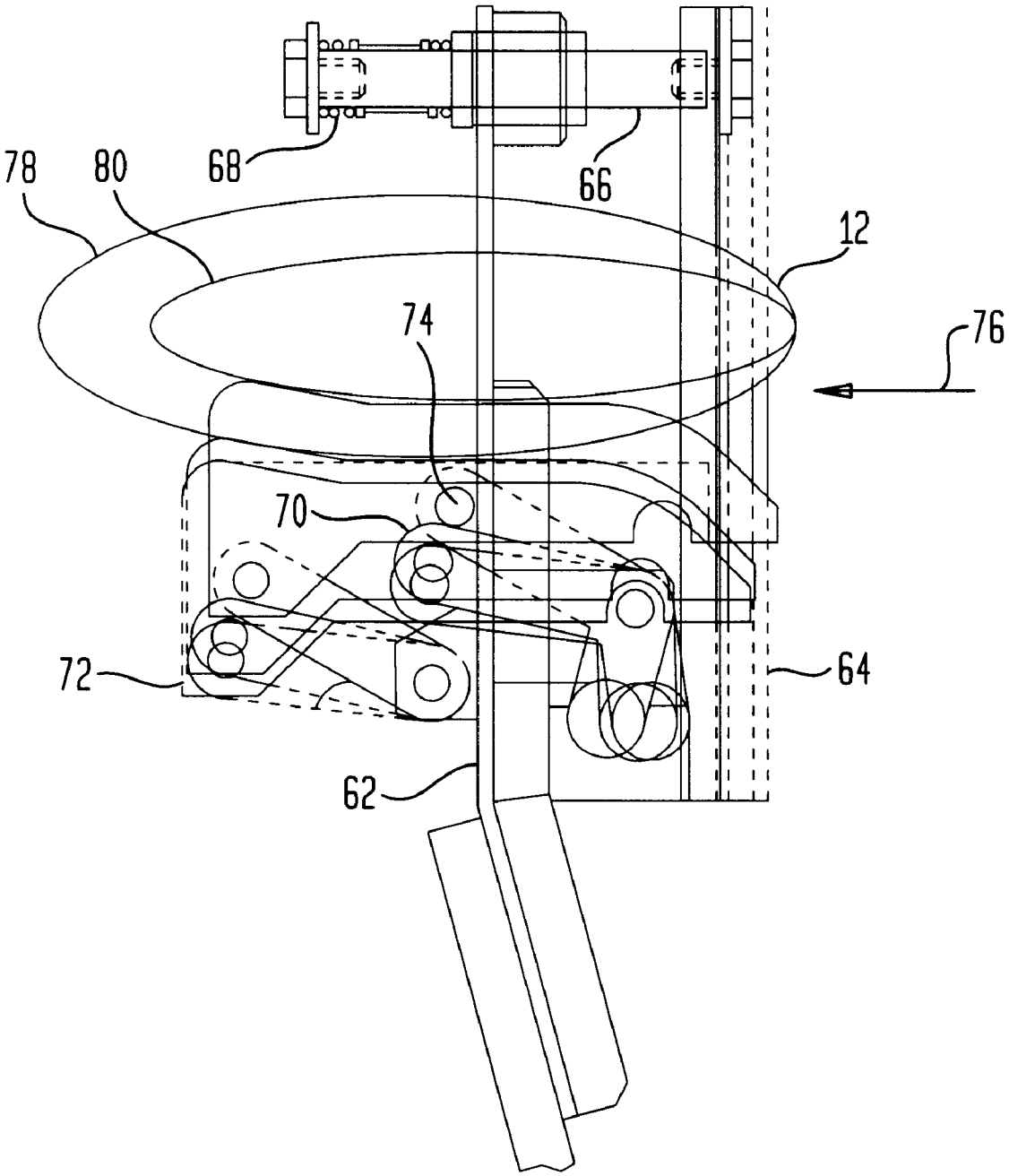
FIG. 5 is an elevational view showing the side view of a chuck assembly.
Figure 6:
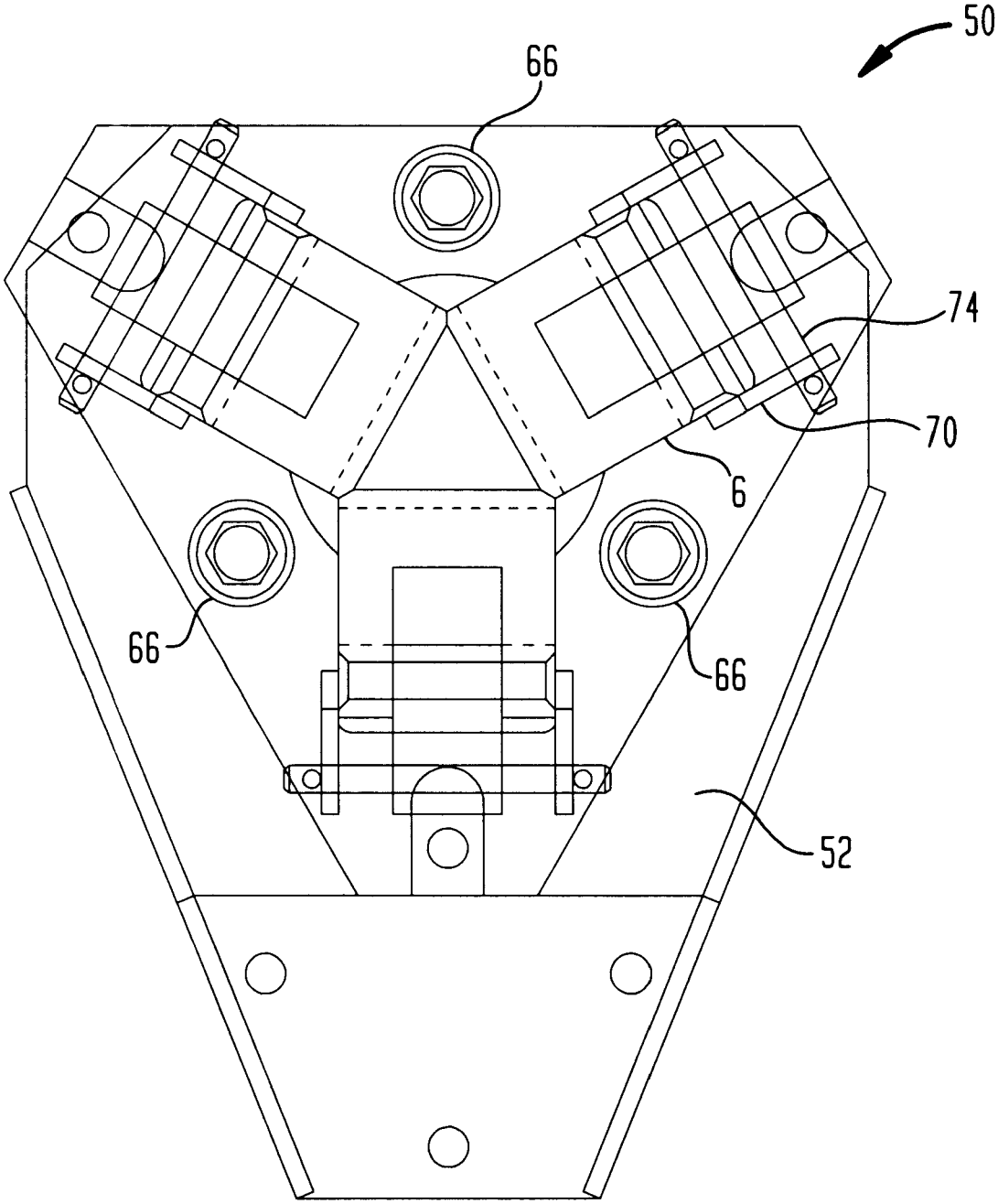
FIG. 6 is an elevational view showing the front view of a chuck assembly.

The chuck assembly, as shown in FIGS. 5 and 6, clamps food articles 12 of varying shapes from approximately one (1) to one and three quarters (1¾) inches in diameter. It is designed to hold the food article 12 in a central position, regardless of its diameter to assure centralized slicing. The loading plunger 54 pushes every food article 12 into the chucks 36 to the same depth, purposefully establishing the entry, or back side, as a length gaging side.

Figure 7:
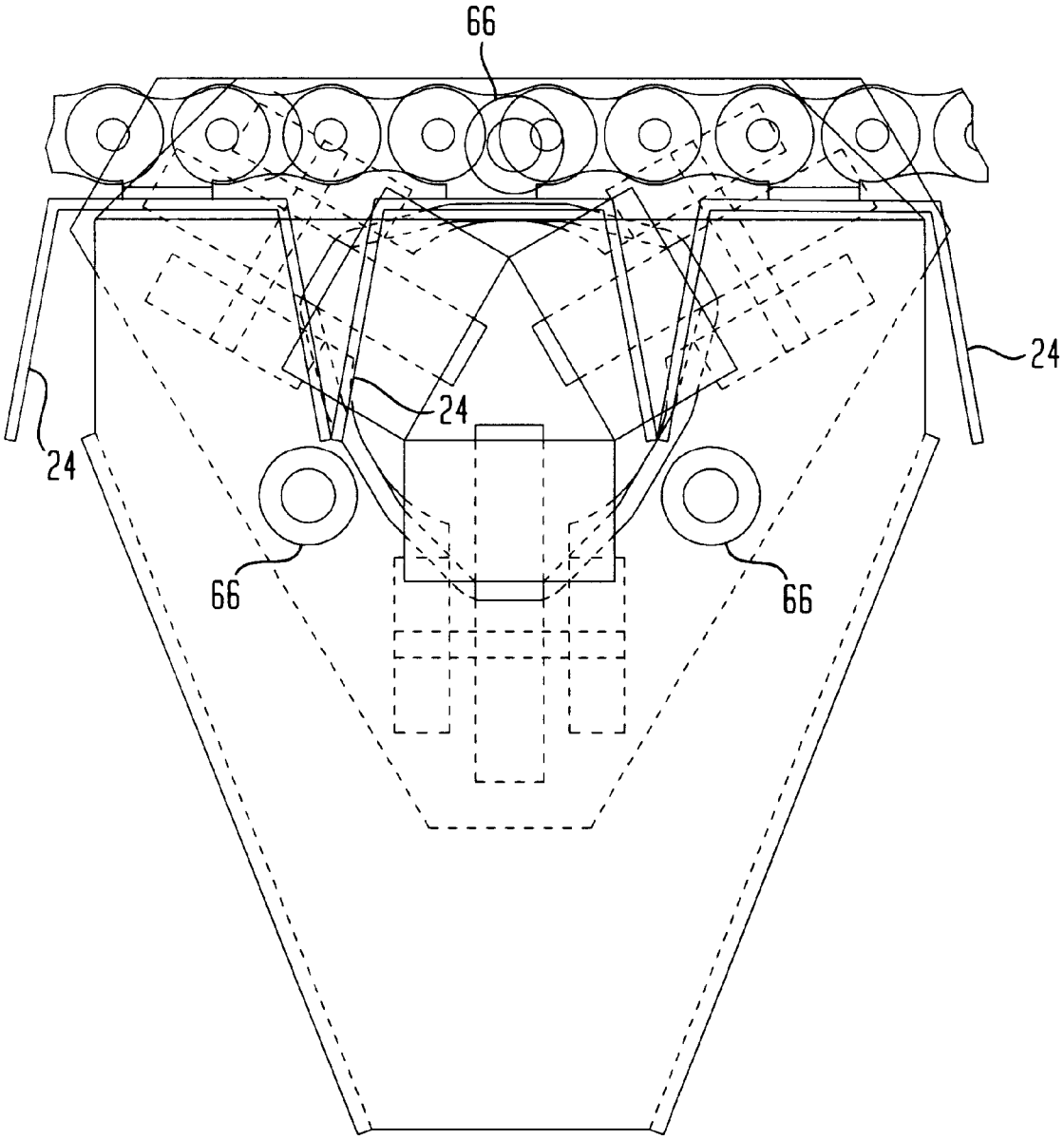
FIG. 7 is an elevational view showing the front view of a chuck assembly in relation to an indexing chain.

The chuck assembly includes a stationary plate 62 and a moveable plate 64, held parallel to one another by three journaled rods 66, biased toward one another by springs 68. They are coupled by the levers 70 that hold the three jaws 72 at pivot points 74. When empty the jaws 72 are at their most central position and the moveable plate 64 is closest to the stationary plate 62. As a food article 12 is inserted into the jaws 72 in the direction of the arrow 76, the jaws 72 are forced apart. The system of levers 70 and parallel plates 62, 64 assures that the jaws 72 move equally, maintaining the food article 12 in a central position. FIG. 7 shows three indexing flights 24 fixed to an indexing chain 22. The centermost flight 24 is in position to feed a food article 12 into the jaws 72. In FIG. 5, the food article 12 is represented by a larger ellipse 78 and a smaller ellipse 80 to signify that the chuck 36 can accommodate food articles 12 in a range of sizes.

As the turrets 34 index counter-clockwise, the chucks 36 sweep past stationary knives (not shown) at positions "P4" and "P5", cutting off any excess length of the food article 12. Thus, the cut length is determined to be no greater than the container length and set from the gaging point at chuck entry. Cut off ends fall into a scrap chute and are led to the back of the apparatus.

Food articles 12 are sliced and inserted into the containers 20 when the loaded chucks 36 have indexed to their lower most position at "G2" and "G3" as shown in FIG. 1. As FIGS. 8–17 show, slicing rams 40 advance to engage the back end of the food articles 12 at both the first and second slicing stations 14, 16, driving through the chuck 36 and through the slicing heads 38. The slicing heads 38 contain vertical blades 82 located on centers in the range of 0.188 inches across the head 38 and staggered in the direction of slicing to prevent compression of the slabs due to blade thickness. Rams 40 are made of elements narrow enough in cross-section to allow passage of ram 40 through the slicing head 38 and into the container 20 to be filled.

FIGS. 8–13 show a slicing head 38 and an associated ram 40 for processing the food article 12 at the first slicing station 14 at G2. This slicing head 38 includes outer slab strippers 84 that divert the outer slabs, which tend to have a large amount of skin, to waste chutes for further processing into relish (see FIG. 23, element 116.). If the customer cites appearance of the filled container as being a premium and is willing to sacrifice yield, these outer slab strippers 84 will be used. The outer slab strippers 84 extend inward by the distance of two slices on both sides being adjacent to the head's second outermost blades (See FIG. 9.) leaving only six slices to enter the container 20 assuring that even a food article 12 of smaller diameter will have the outermost surfaces shaved away. A wedge shaped deflector 86 (labeled "splitter wedge" in FIG. 8) located in the middle of the slicing head exit throat, splits the compliment of slabs down the center, sending half to each side of the container 20. This exposes the flat or "meat" surface of the slabs to about one third (⅓) of the container's surface. In order to accomplish this, the splitter wedge 86 is tapered front to back to present a knife edge 88 at the exit face of the slicing head 38. The outer slabs (shavings) are deflected via chutes to the rear of the apparatus.

Figure 8:
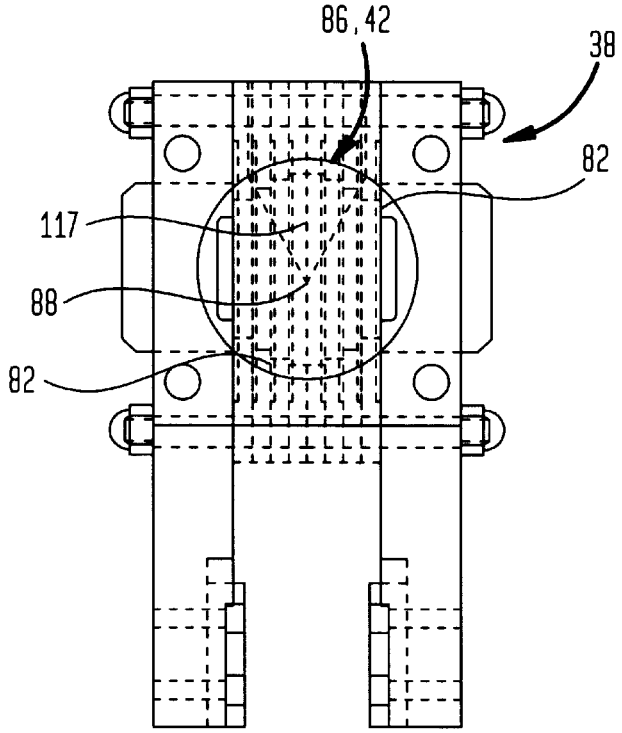
FIG. 8 is an elevational view showing the front view of the slicing head of the first slicing station.
Figure 8A:
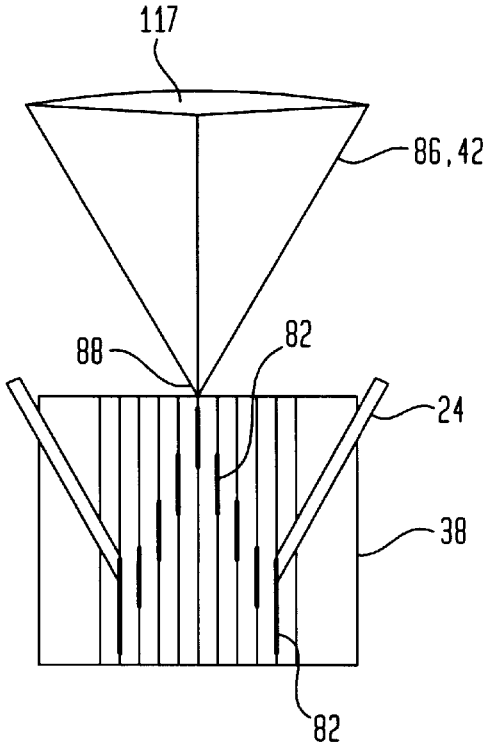
FIG. 8A is a bottom view of the slicing head of FIG. 8.
Figure 9:
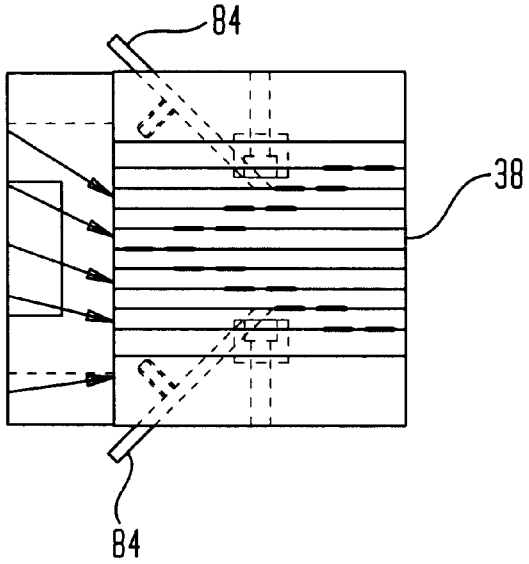
FIG. 9 is a plan view showing the top view of the slicing head of the first slicing station.
Figure 10:
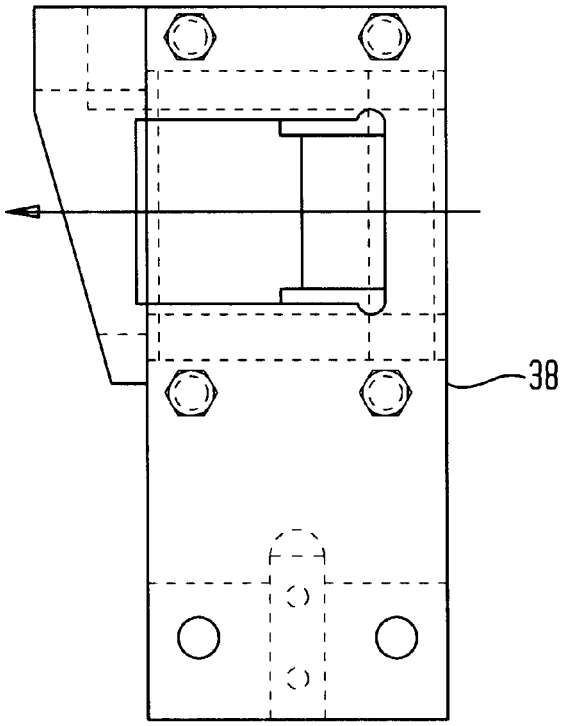
FIG. 10 is an elevational view showing the side view of the slicing head of the first slicing station.
Figure 11:
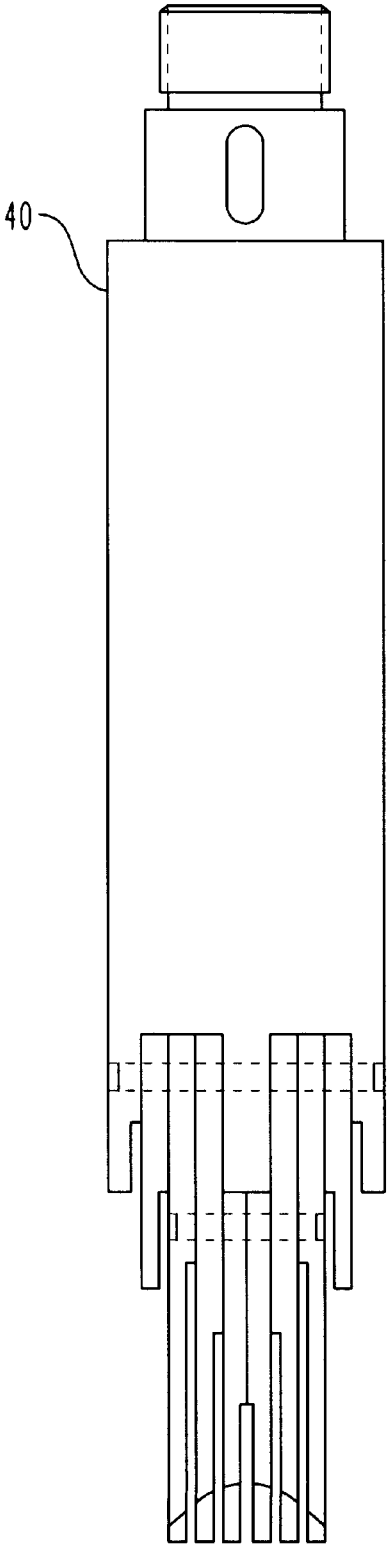
FIG. 11 is a plan view showing the top view of the slicing ram of the first slicing station.
Figure 12:
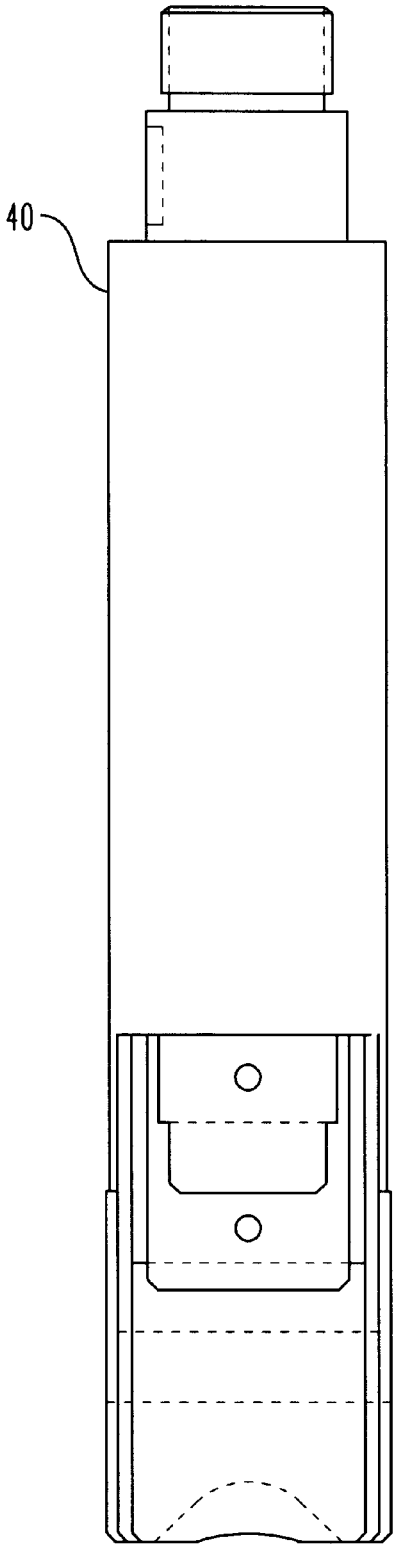
FIG. 12 is an elevational view showing the side view of the slicing ram of the first slicing station.
Figure 13:
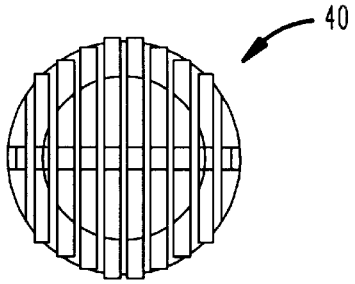
FIG. 13 is an elevational view showing the front view of the slicing ram of the first slicing station.
Figure 14:
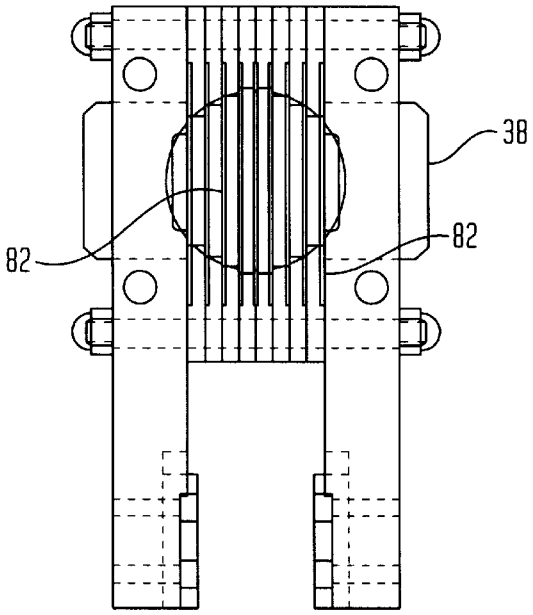
FIG. 14 is an elevational view showing the front view of the slicing head of the second slicing station.
Figure 15:
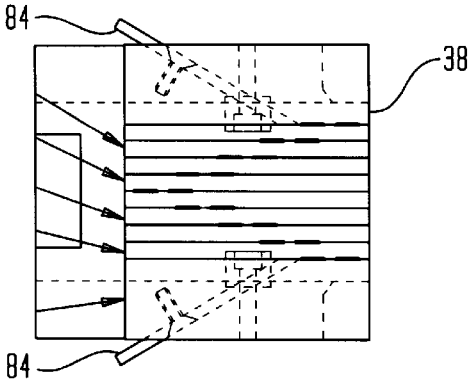
FIG. 15 is a plan view showing the top view of the slicing head of the second slicing station.
Figure 16:
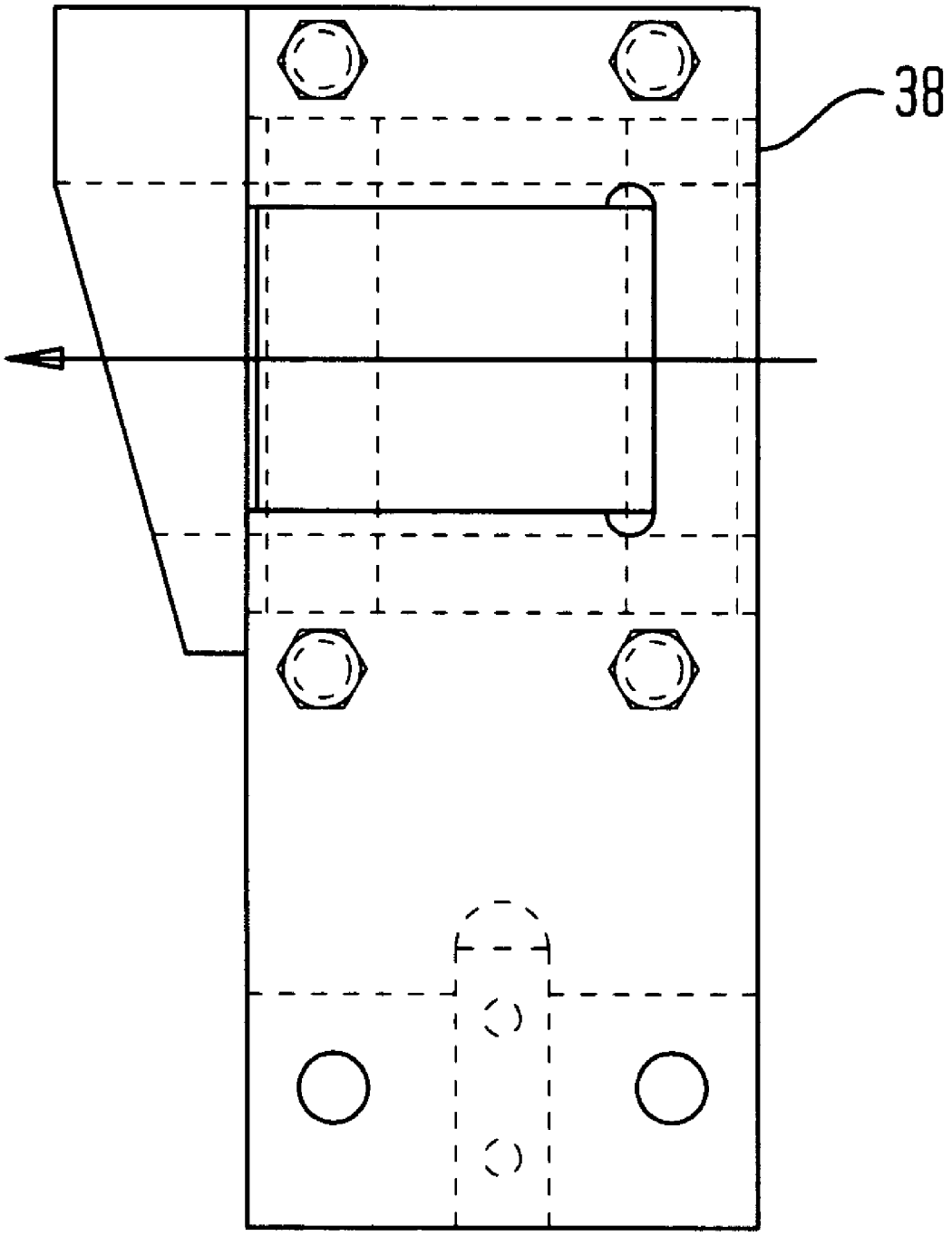
FIG. 16 is an elevational view showing the side view of the slicing head of the second slicing station.
Figure 17:
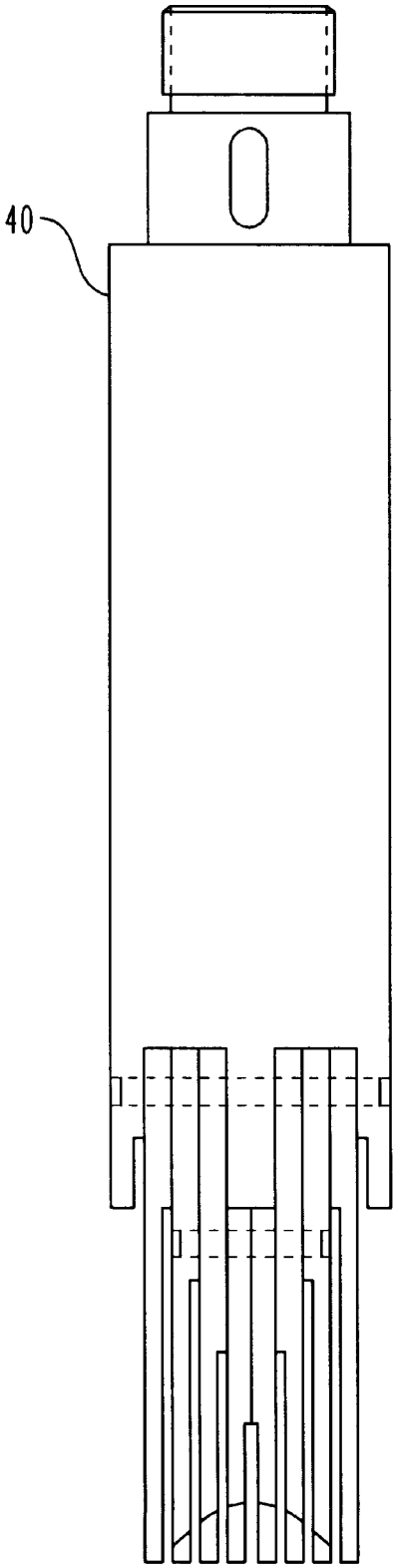
FIG. 17 is a plan view showing the top view of the slicing ram of the first slicing station.
Figure 18:
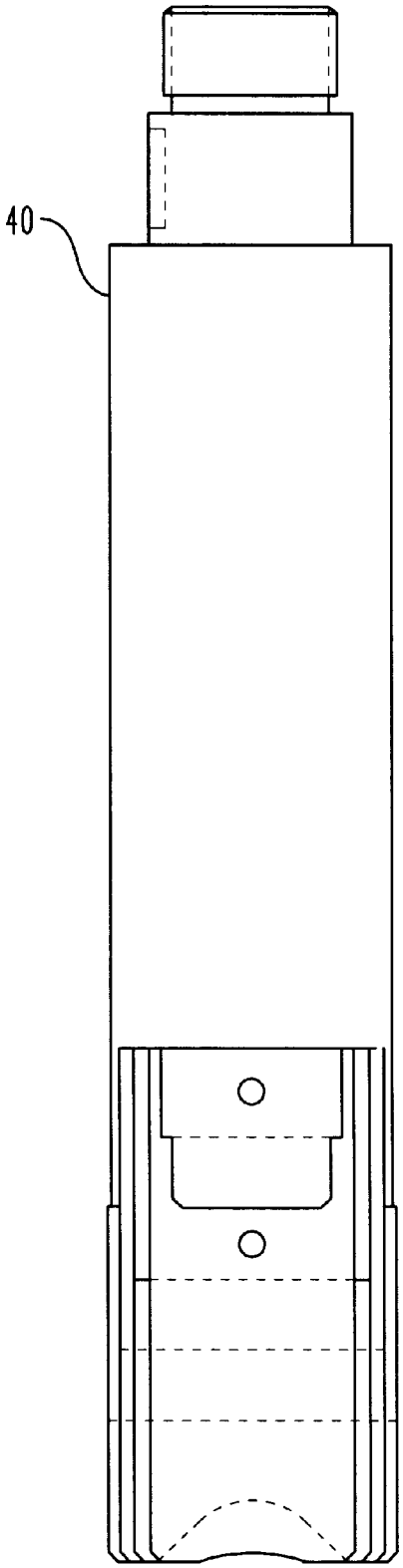
FIG. 18 is an elevational view showing the side view of the slicing ram of the first slicing station.
Figure 19:
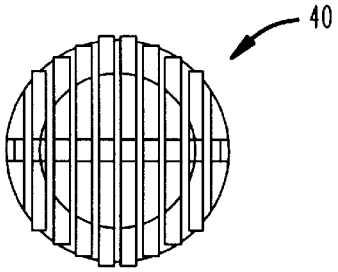
FIG. 19 is an elevational view showing the front view of the slicing ram of the first slicing station.

FIG. 8A shows a bottom view of the slicing head 38 illustrated in FIG. 8. The splitter wedge 86 is shown in slight perspective to show the face 117 of the splitter wedge of FIG. 8. The splitter wedge presents a knife edge 88 at the face of the slicing head and spreads to a V-shape at the distal face 117.

Conveyance through the apparatus is designed to keep the containers 20 from rotating between the first and second slicing stations 14, 16 thereby keeping the "meat" surface of the slabs flat against the container 20 for an unobstructed second filling as well as to assure attractive store shelf appearance.

FIGS. 14–19 show a standard slicing head 38 and ram 40 used at the second slicing station 16 (G3 of FIG. 1). Full utilization is derived with these components, with outer skins removed only from food articles 12 in the larger diameter ranges. The food article 12 is sliced in a similar method as in the first slicing station 14. However, the second slicing station 16 does not contain a splitter wedge 86. Therefore, the sliced food article loosely retains its original whole shape when it enters the container 20. This arrangement permits the "V"-shaped area formed by the first sliced food article to be filled more easily resulting in slabs lying against both sides of the inside container surface.

Figure 23:
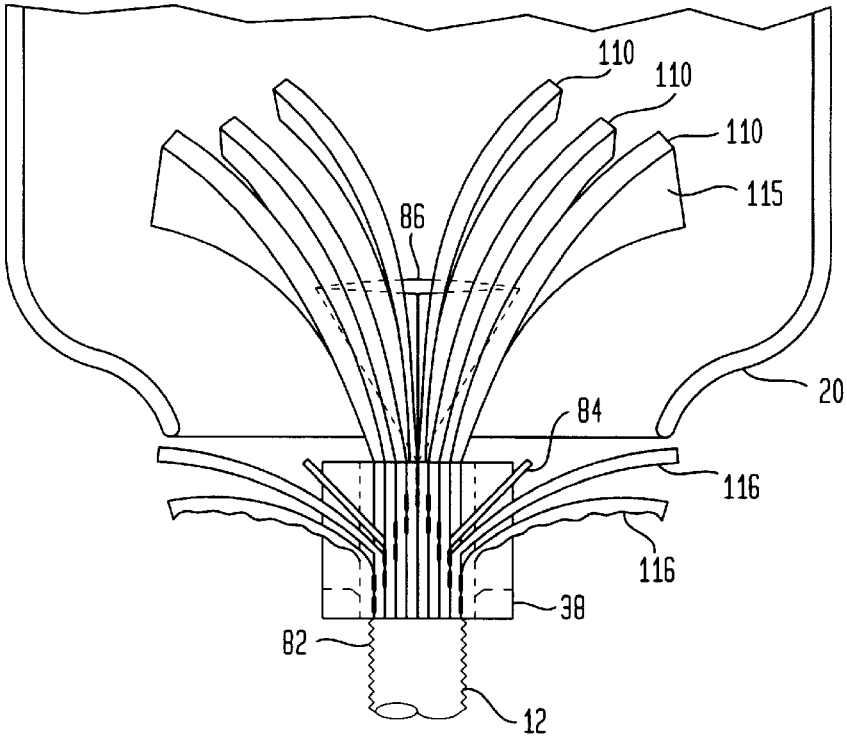
FIG. 23 is a bottom view of a first slicing station slicing head slicing a food article.

FIG. 23 shows slabs 110 emerging from a first slicing station 14 slicing head 38 with a splitter wedge 86. The splitter wedge separates the slabs 110 of the food article 12 into two groups, diverting the slabs 110 to the left and right side of container 20 and causes them to fan out so that their meat sides 115 lay along the container wall. The outer slabs 116 are deflected away from the container 20 by the outer slab strippers 84.

Figure 22:
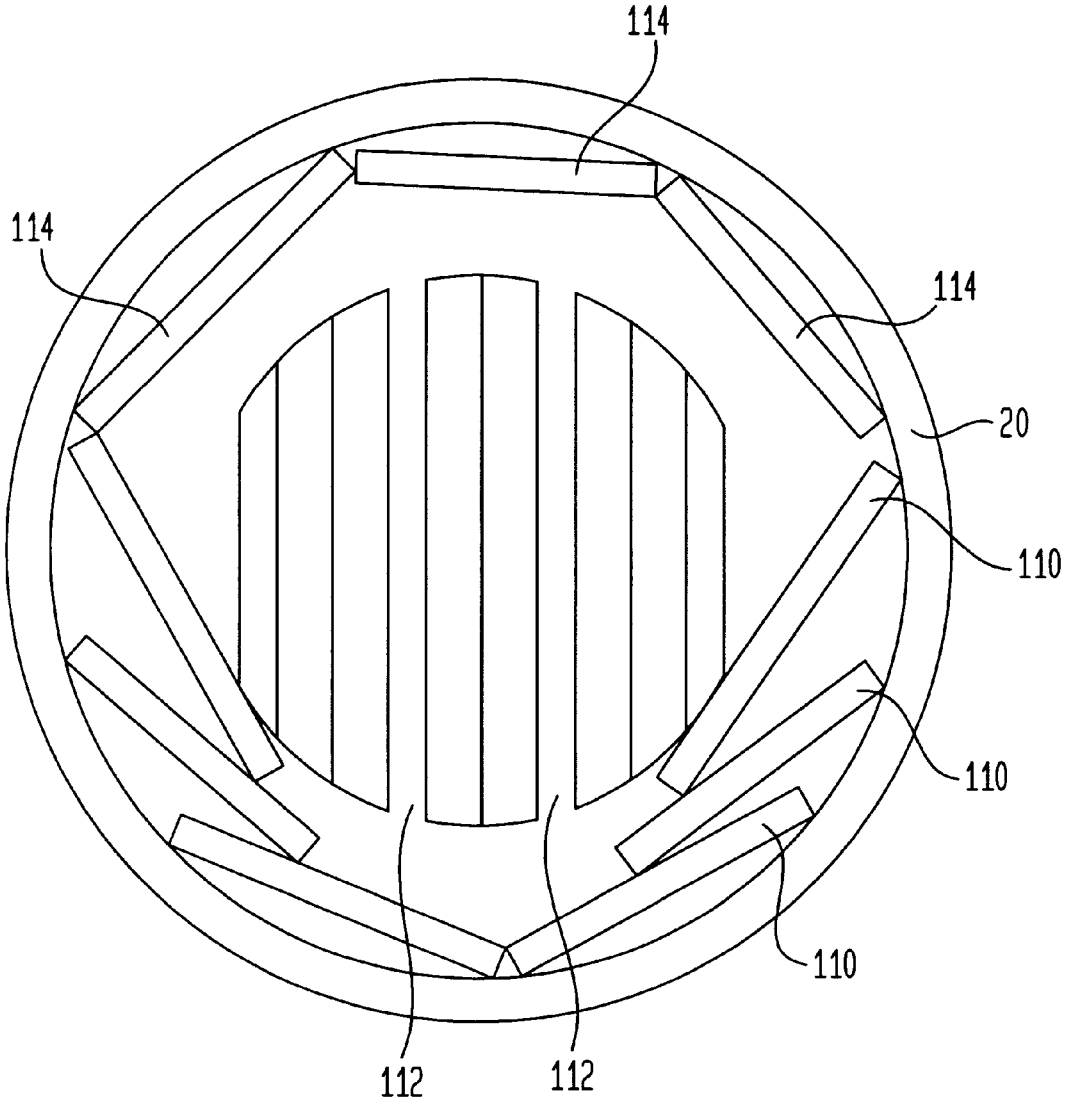
FIG. 22 is a cross sectional view of a filled container.
Figure 24:
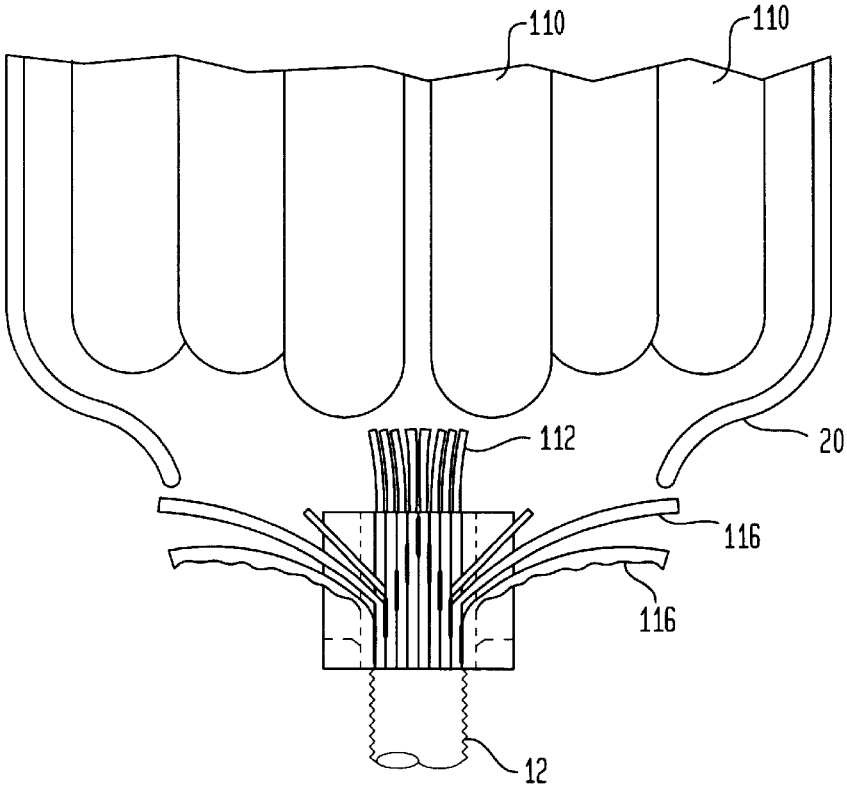
FIG. 24 is a top view of a second slicing station slicing head inserting slices into a partially filled container.

FIG. 24 shows slabs 112 emerging from a second slicing station 16 slicing head 38. Since there is no splitter wedge the slabs 112 emerge approximately parallel to one another and are introduced into the center of a container 20 that already contains slabs 110, as also illustrated in FIG. 22.

Additional "make-up" slices 114 (see FIG. 22) needed to more completely fill the containers 20 are inserted by hand after the containers 20 are conveyed from the apparatus. The additional make-up slices will generally be placed around the second food article to, in conjunction with the first food article slab array, result in nearly full "meat" presentation of the container's contents.

Figure 20:
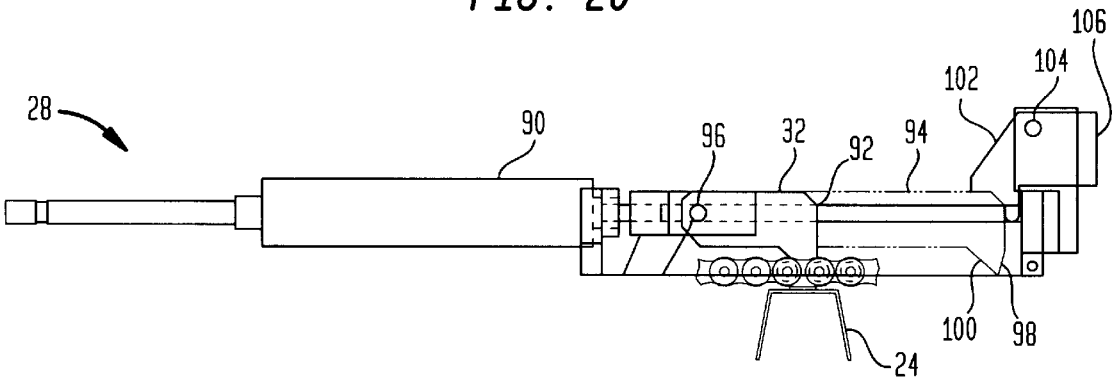
FIG. 20 is an elevational view showing the side view of the indexing drive.
Figure 21:
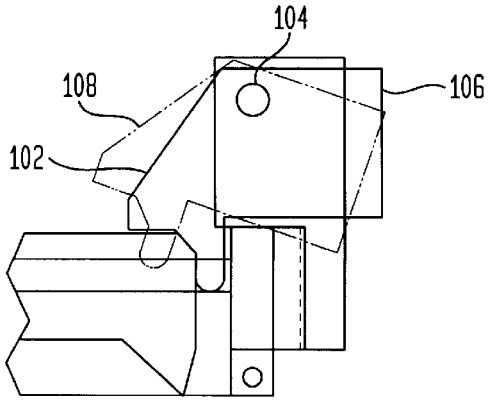
FIG. 21 is an elevational view showing the side view of the drive head and the clamp.

FIG. 20 shows the mechanism that advances the indexing chain 22 by precisely two flights during each slicing cycle. This mechanism is shown in place at P1 of FIG. 1. In this mechanism, a pneumatic cylinder 90 advances the drive head 32 from the retracted position 92 to the advanced position 94. The drive head 32 is free to pivot around the pivot point 96. The head's 32 driving face 98 is perpendicular to the line between the pivot point 96 and the point of contact between the driving face 98 and the indexing chain link 26 being driven. The rear face 100 of the drive head 32 is formed at a shallower angle so that the head 32 is free to ride up over the chain 22 as the head 32 is retracted for the start of the next cycle. The precision of the stopping point is assured by a stopping clamp 102. This clamp 102 freely pivots about pivot point 104 and is counterbalanced by the end 106 away from the drive head 32 in such a way that, when the drive head 32 is retracted the clamp 102 rotates to its open position. (See dashed outline 108 in FIG. 21). When the drive head 32 advances, the clamp 102 rotates counterclockwise, bringing the drive head 32 to a stop and pressing the head 32 down between the drive chain links 26, precisely determining the stopping position.

While the present invention has been described in connection with what is considered to be the most preferred embodiments, it is to be understood that the present invention is not limited to the disclosed embodiments but is intended to cover various arrangements and constructions included within the spirit and scope of the broadest interpretation so as to encompass all such modifications and equivalent arrangements.

What is claimed is:

1. An apparatus for slicing an elongated food article into a plurality of longitudinal slabs and inserting slabs from the food article into a container, comprising:

(a) an indexing feeder comprising an indexing chain, a plurality of feed troughs, each independently affixed to a link of the indexing chain at a distance of one flight from neighboring troughs, and an indexing drive for advancing the indexing chain;

(b) a first slicing station disposed along the indexing feeder, comprising an indexing turret with a plurality of self-centering chucks disposed around the periphery of the turret, means for rotating the turret such that each chuck is carried from a filling position to a slicing position, means for inserting a food article from a trough into each chuck as the trough is brought into alignment with the chuck at the filling position, a slicing head having a lateral outer edge and a center, a slicing ram for thrusting the food article through the slicing head as the chuck is brought into alignment with the slicing head at the slicing position, a splitter wedge extending from the slicing head, the splitter wedge being V-shaped at the end distal to the slicing head and tapering to a knife edge proximal to the slicing head at the center line of the slicing head, whereby emerging slabs are separated into two equal portions in spaced relationship to one another; and (c) a container conveyor system including a conveyor belt, means for feeding containers onto the conveyor belt, means for guiding the containers to a filling angle as the containers are conducted to the slicing station, and means at the slicing station for elevating the containers from the conveyor belt to the slicing head for filling each of said containers with said slabs and returning the containers to the conveyor belt after filling.

2. An apparatus as set forth in claim 1, in which each of the plurality of self-centering chucks is capable of accommodating food articles having different sizes.

3. An apparatus as set forth in claim 1, in which the slicing station further comprises a stationary knife to trim the food articles secured in the plurality of self-centering chucks to a predetermined length as each chuck is carried from the filling position to the slicing position.

4. An apparatus as set forth in claim 1, in which the slicing head comprises a plurality of vertical blades staggered from the outer edge to the center in the slicing direction so as to prevent compression of slabs during slicing.

5. An apparatus as set forth in claim 1, in which the slicing head further comprises a pair of outer slab strippers positioned symmetrically inward from the outer edge of the slicing head adjacent to the head's second outermost blades for diverting the two outermost slabs emerging from the slicing head, away from the container.

6. An apparatus as set forth in claim 1, in which the container conveyor system further comprises means for preventing the containers from rotating while the containers are being filled.

7. An apparatus as set forth in claim 1, in which the filling angle is approximately forty five degrees to assure that the slabs come to rest against the bottom of the container and lying approximately parallel to one another against the side of the container.

8. An apparatus as set forth in claim 1 further comprises a second slicing station disposed along the indexing feeder by an odd number of flights, comprising an indexing turret with a plurality of self-centering chucks disposed around the periphery of the turret, means for rotating the turret such that each chuck is carried from a filling position to a slicing position, means for inserting a food article from a trough into each chuck as the trough is brought into alignment with the chuck at the filling position, a slicing head, a slicing ram for thrusting the food article through the slicing head as the chuck is brought into alignment with the slicing head at the slicing position, whereby the emerging slabs are maintained approximately parallel to one another.

9. Apparatus for slicing an elongated food article into a plurality of longitudinal slabs and inserting slabs from the food article into a container, comprising:

(a) an indexing feeder comprising an indexing chain, a plurality of feed troughs, each independently affixed to a link of the indexing chain at a distance of one flight from neighboring troughs, and an indexing drive for advancing the indexing chain;

(b) a slicing station disposed along the indexing feeder, comprising an indexing turret with a plurality of self-centering chucks disposed around the periphery of the turret, each self-centering chuck being capable of accommodating food articles having different sizes, means for rotating the turret such that each chuck is carried from a filling position to a slicing position, means for inserting a food article from a trough into each chuck as the trough is brought into alignment with the chuck at the filling position, a stationary knife to trim the food articles secured in the plurality of self-centering chucks to a predetermined length as each chuck is carried from the filling position to the slicing position, a slicing head with a lateral outer edge and a center, having a plurality of vertical blades staggered in the slicing direction from the outer edge to the center so as to prevent compression of slabs during each slicing cycle, and a plurality of outer slab strippers extending inward by a distance of at least two slabs from the outer edge of the slicing head for diverting the outermost slabs, a slicing ram for thrusting the food article through the slicing head as the chuck is brought into alignment with the slicing head at the slicing position, a splitter wedge extending from the slicing head, the splitter wedge being V-shaped at the end distal to the slicing head and tapering to a knife edge proximal to the slicing head at the center line of the slicing head, whereby emerging slabs are separated into two equal and spaced portions; and (c) a container conveyor system including a conveyor belt, means for feeding containers onto the conveyor belt, means for guiding the containers to a filling angle as the containers are conducted to the slicing station to assure that the slabs come to rest against the bottom of the container and lying approximately parallel to one another against the side of the container, and means at the slicing station for elevating the containers from the conveyor belt to the slicing head for filling each of said containers with said slabs and returning the containers to the conveyor belt after filling, and means for preventing the containers from rotating while the containers are being filled.

10. An apparatus for slicing elongated food articles into a plurality of longitudinal slabs and inserting slabs from at least two of the food articles into a container, comprising:

(a) an indexing feeder comprising an indexing chain, a plurality of feed troughs, each independently affixed to a link of the indexing chain at a distance of one flight from neighboring troughs, and an indexing drive for advancing the indexing chain a distance of two flights during each slicing cycle;

(b) a first slicing station and a second slicing station disposed along the indexing feeder, the second slicing station being displaced from the first slicing station by an odd number of flights, each slicing station comprising an indexing turret with a plurality of self-centering chucks disposed around the periphery of the turret, means for rotating the turret such that each chuck is carried from a filling position to a slicing position, means for inserting a food article from a trough into each chuck as the trough is brought into alignment with the chuck at the filling position, a slicing head, a slicing ram for thrusting the food article through the slicing head as the chuck is brought into alignment with the slicing head at the slicing position, a splitter wedge extending from the slicing head of the first slicing station, the splitter wedge being V-shaped at the end distal to the slicing head and tapering to a knife edge proximal to the slicing head at the center line of the slicing head, whereby slabs emerging from the first slicing station are separated into two equal portions in spaced relationship to one another; and (c) a container conveyor system including a conveyor belt, means for feeding containers onto the conveyor belt, means for guiding the containers to a filling angle as the containers are conducted to the first and the second slicing stations, and means at the first and the second slicing stations for elevating the containers from the conveyor belt to each slicing head for filling each of said containers with said slabs and returning the containers to the conveyor belt after filling.

11. An apparatus as set forth in claim 10, in which each of the plurality of self-centering chucks is capable of accommodating food articles having different sizes.

12. An apparatus as set forth in claim 10, in which the first and the second slicing stations each further comprises a stationary knife to trim the food articles secured in the plurality of self-centering chucks to a predetermined length as each chuck is rotated from the filling position to the slicing position.

13. An apparatus as set forth in claim 10, in which the slicing head comprises a plurality of vertical blades staggered in the slicing direction so as to prevent compression of slabs during each slicing cycle.

14. An apparatus as set forth in claim 10, in which the slicing head having an outer periphery further comprises a plurality of outer slab strippers extending inward symmetrically by a distance of at least two slabs from the outer periphery of the slicing head for diverting the outermost slabs.

15. An apparatus as set forth in claim 10, in which the container conveyor system further comprises means for preventing the containers from rotating while the containers are being conveyed from the first slicing station to the second slicing station and while they are being filled.

16. An apparatus as set forth in claim 10, in which the container conveyor system further comprises means for preventing a second container from entering the first and the second slicing stations during each slicing cycle.

17. An apparatus as set forth in claim 10, in which the filling angle is optimized to assure that the slabs come to rest against the bottom of the container and lying approximately parallel to one another against the side of the container.

18. An apparatus as set forth in claim 10, in which the filling angle at the second slicing station is adjusted to ensure that slabs outputted from the second slicing station will be inserted into the V-shaped area formed by the slabs outputted from the first slicing station within the container.

19. An apparatus as set forth in claim 10, in which the indexing drive comprises:

(a) a drive head capable of assuming a retracted or an advanced position; and (b) a pneumatic cylinder for moving the drive head to one of its positions.

20. An apparatus as set forth in claim 19, in which the indexing drive further comprises a clamp for preventing the drive head from being moved by the pneumatic cylinder beyond a predetermined distance.

21. An apparatus for slicing elongated food articles into a plurality of longitudinal slabs and inserting slabs from at least one of the food articles into a container, comprising:

(a) an indexing feeder for conveying a plurality of food articles;

(b) a plurality of chuck assemblies for receiving and securing the plurality of food articles conveyed from the indexing feeder, each chuck assembly being capable of receiving and securing one food article;

(c) a slicing mechanism for slicing a food article into a plurality of longitudinal slabs;

(d) a turret for rotating the plurality of chuck assemblies in a sequential manner such that the food article secured in each chuck assembly is aligned with the slicing mechanism in a proper position for slicing;

(e) means for thrusting the food article secured in a chuck assembly into the slicing mechanism for slicing into longitudinal slabs;

(f) means for dividing the slabs into two equal and spaced portions and inserting both portions into the container; and (g) a conveyor mechanism for conveying and aligning the container with the dividing and inserting means so as to allow the container to receive the slabs.

22. An apparatus as set forth in claim 21, in which the indexing feeder comprises an indexing chain, a plurality of feed troughs, each independently affixed to a link of the indexing chain at a distance of one flight from neighboring troughs, and an indexing drive for advancing the indexing chain.

23. An apparatus of claim 22, in which the indexing drive comprises a drive head capable of assuming a retracted or an advanced position, a pneumatic cylinder for moving the drive head to one of its positions, and a clamp for preventing the drive head from being moved by the pneumatic cylinder beyond a predetermined distance.

24. An apparatus as set forth in claim 21, in which each of the plurality of chuck assemblies is capable of accommodating food articles having different sizes.

25. An apparatus as set forth in claim 21 further comprising a stationary knife to trim the food articles secured in the plurality of chuck assemblies to a predetermined length as each chuck assembly is rotated by the turret to align with the slicing mechanism into the proper position for slicing.

26. An apparatus as set forth in claim 21, in which the slicing mechanism comprises a plurality of vertical blades staggered in the slicing direction so as to prevent compression of slabs during slicing.

27. An apparatus as set forth in claim 21, in which the dividing and inserting means comprises a splitter wedge extending from the slicing mechanism, the splitter wedge being V-shaped at the distal end to the slicing mechanism and tapering to a knife edge proximal to the slicing mechanism at the center line of the slicing mechanism.

28. An apparatus as set forth in claim 21, in which the conveyor mechanism further comprises means for preventing the container from rotating while the container is being filled.

29. An apparatus as set forth in claim 21, in which the conveyor mechanism further comprises means for guiding the container to receive the slabs at a filling angle so as to ensure that the slabs come to rest against the bottom of the container and lying approximately parallel to one another against the side of the container.

30. An apparatus for slicing elongated food articles into a plurality of longitudinal slabs and inserting slabs from at least two of the food articles into a container, comprising:

(a) an indexing feeder for conveying a plurality of food articles;

(b) a first station and a second station disposed along the indexing feeder, each station comprising a plurality of chuck assemblies for receiving and securing the plurality of food articles conveyed from the indexing feeder, each chuck assembly being capable of receiving and securing one food article, a slicing mechanism for slicing a food article into a plurality of longitudinal slabs, a turret for rotating the plurality of chuck assemblies in a sequential manner such that the food article secured in each chuck assembly is aligned with the slicing mechanism in a proper position for slicing, means for thrusting the food article secured in a chuck assembly into the slicing mechanism for slicing into longitudinal slabs, means in the first station for dividing the slabs into two equal and spaced portions and inserting both portions into the container, in spaced relationship means in the second station for inserting the slabs between the equal portions; and (c) a conveyor mechanism for conveying and aligning the container with the dividing and inserting means at the first and the second stations so as to allow the container to receive the slabs.

31. An apparatus as set forth in claim 30, in which the indexing feeder comprises an indexing chain, a plurality of feed troughs, each independently affixed to a link of the indexing chain at a distance of one flight from neighboring troughs, and an indexing drive for advancing the indexing chain a distance of two flights during each slicing cycle.

32. An apparatus as set forth in claim 30, in which the second station is displaced from the first station by an odd number of flights.

33. An apparatus as set forth in claim 30, in which each of the plurality of chuck assemblies is capable of accommodating food articles having different sizes.

34. An apparatus as set forth in claim 30 further comprising a stationary knife to trim the food articles secured in the plurality of chuck assemblies to a predetermined length as each chuck assembly is rotated by the turret to align with the slicing mechanism into the proper position for slicing.

35. An apparatus as set forth in claim 30, in which the slicing mechanism comprises a plurality of vertical blades staggered in the slicing direction so as to prevent compression of slabs during slicing.

36. An apparatus as set forth in claim 30, in which the means for dividing comprises a splitter wedge extending from the slicing mechanism, the splitter wedge being V-shaped at the distal end to the slicing mechanism and tapering to a knife edge proximal to the slicing mechanism at the center line of the slicing mechanism.

37. An apparatus as set forth in claim 30, in which the conveyor mechanism further comprises means for preventing the container from rotating while the container is being filled.

38. An apparatus as set forth in claim 30, in which the conveyor mechanism further comprises means for guiding the container to receive the slabs at a filling angle at the first and the second stations so as to ensure that the slabs come to rest against the bottom of the container and lying approximately parallel to one another against the side of the container.

39. An apparatus as set forth in claim 38, in which the filling angle at the second station is adjusted to ensure that slabs outputted from the second station will be inserted behind slabs outputted from the first station within a container.

* * * * *